US008764405B2

(12) United States Patent
Mashak et al.

(10) Patent No.: US 8,764,405 B2
(45) Date of Patent: Jul. 1, 2014

(54) DYNAMIC COMPENSATION OF AIRFLOW IN ELECTRONICS ENCLOSURES WITH FAILED FANS

(71) Applicant: International Business Machines Corporation, Armonk, NY (US)

(72) Inventors: Benjamin William Mashak, Rochester, MN (US); Arden Lot Moore, Cedar Park, TX (US); Katie L. Pizzolato, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/741,143

(22) Filed: Jan. 14, 2013

(65) Prior Publication Data

US 2014/0037462 A1 Feb. 6, 2014

Related U.S. Application Data

(63) Continuation of application No. 13/562,597, filed on Jul. 31, 2012.

(51) Int. Cl.

| | |
|---|---|
| ***F04B 41/06*** | (2006.01) |
| ***F04B 49/22*** | (2006.01) |
| ***H05K 5/00*** | (2006.01) |

(52) U.S. Cl.

USPC ..... 417/3; 417/28; 417/427; 417/53; 361/679.5; 361/695; 454/184

(58) Field of Classification Search

USPC ..... 417/3, 26, 28, 426, 427, 53; 165/80.2, 165/80.3; 361/694, 695, 679.47–679.51; 454/184

See application file for complete search history.

(56) References Cited

U.S. PATENT DOCUMENTS

| | | | | |
|---|---|---|---|---|
| 6,554,697 | B1 | 4/2003 | Koplin | 454/184 |
| 6,587,340 | B2 | 7/2003 | Grouell et al. | 361/695 |
| 6,735,079 | B2 | 5/2004 | Huang | 361/695 |
| 6,991,533 | B2 * | 1/2006 | Tsai et al. | 454/184 |
| 7,075,788 | B2 | 7/2006 | Larson et al. | 361/695 |
| 7,663,881 | B2 | 2/2010 | Kuo | 361/692 |
| 7,715,193 | B1 | 5/2010 | Ye et al. | 361/695 |
| 7,733,646 | B2 | 6/2010 | Hisatsune | 361/690 |
| 7,903,418 | B2 | 3/2011 | Tracy et al. | 361/714 |
| 8,120,911 | B2 | 2/2012 | Zhou et al. | 361/695 |
| 2005/0168942 | A1 * | 8/2005 | Steinbrecher | 361/690 |
| 2005/0241810 | A1 * | 11/2005 | Malone et al. | 165/122 |
| 2011/0184568 | A1 * | 7/2011 | Tai et al. | 700/282 |

* cited by examiner

*Primary Examiner* — Charles Freay

(74) *Attorney, Agent, or Firm* — Van Leeuwem & Van Leeuwen; Matthew W. Baca

(57) ABSTRACT

An approach is provided in which a cooling manager detects a failed fan included in an electronic enclosure. The electronic enclosure includes multiple fans that each cool different component areas in the electronic enclosure. The cooling manager selects an airflow compensator that corresponds to a functioning fan included in the electronic enclosure, which includes a fixed perforated member and a movable perforated member. In turn, the cooling manager adjusts the selected airflow compensator to redirect a portion of airflow generated by the functioning fan to the component area corresponding to the failed fan.

9 Claims, 6 Drawing Sheets

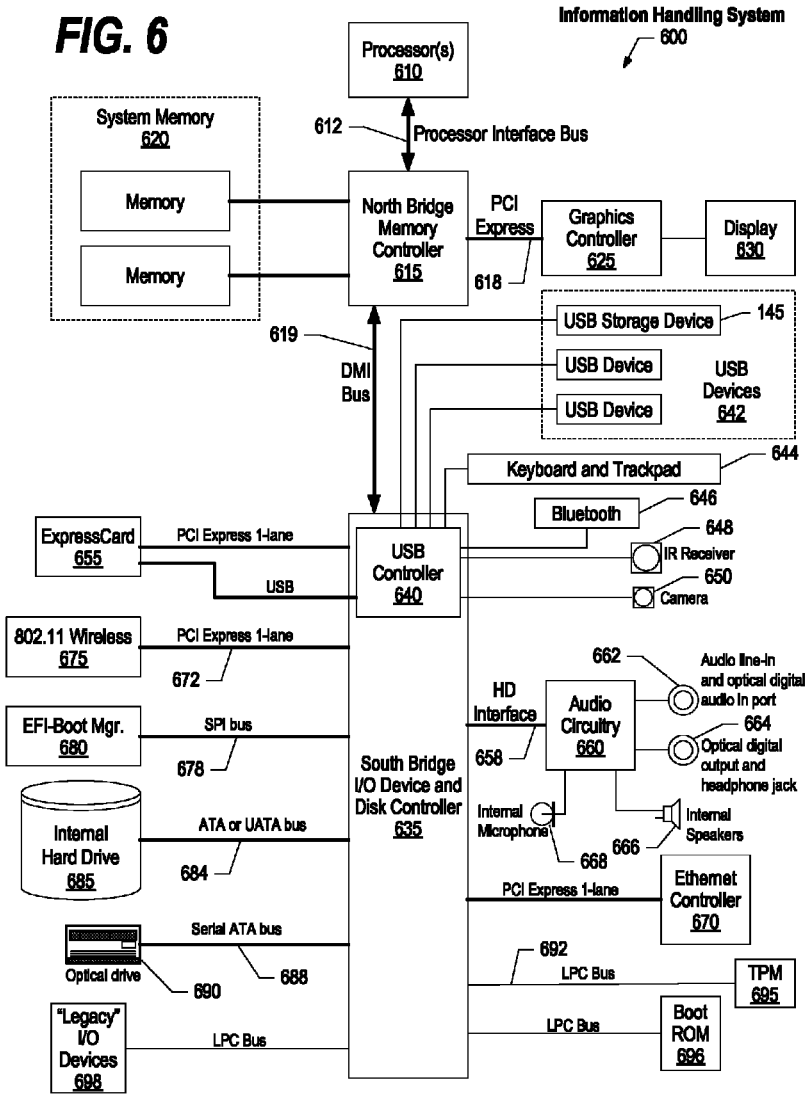
FIG. 6
Information Handling System
600
Processor(s)
610
System Memory
620
612
Processor Interface Bus
Memory
Memory
North Bridge
Memory
Controller
615
PCI
Express
618
Graphics
Controller
625
Display
630
619
DMI
Bus
USB Storage Device
145
USB Device
USB Device
USB
Devices
642
Keyboard and Trackpad
644
Bluetooth
646
ExpressCard
655
PCI Express 1-lane
USB
USB
Controller
640
648
IR Receiver
650
Camera
802.11 Wireless
675
PCI Express 1-lane
672
662
Audio line-in
and optical digital
audio in port
HD
Interface
Audio
Circuitry
660
664
Optical digital
output and
headphone jack
EFI-Boot Mgr.
680
SPI bus
678
658
South Bridge
I/O Device and
Disk Controller
635
Internal
Hard Drive
685
ATA or UATA bus
684
Internal
Microphone
668
666
Internal
Speakers
PCI Express 1-lane
Ethernet
Controller
670
Serial ATA bus
Optical drive
690
688
692
LPC Bus
TPM
695
"Legacy"
I/O
Devices
698
LPC Bus
LPC Bus
Boot
ROM
696

DYNAMIC COMPENSATION OF AIRFLOW IN ELECTRONICS ENCLOSURES WITH FAILED FANS

BACKGROUND

The present disclosure relates to redirecting a portion of airflow generated by functioning fans located in an electronic enclosure to components downstream of failed fans located in the electronic enclosure.

Electronics enclosures may include redundant fans, or air-moving devices (AMDs), to prevent overheating of power-dissipating components in the event of an AMD failure. Upon the failure of an AMD, the remaining functional AMDs may increase their respective airflow rates to compensate for the failed AMD. However, despite the increase in total system airflow rate, the ability of the remaining functional AMDs to effectively cool each individual component within the enclosure may be limited due to uneven spatial distribution of the airflow in a region directly downstream of the failed AMDs.

Often the components (processor, memory modules, etc.) directly downstream of a failed AMD receive less airflow than neighboring components and in turn experience higher temperatures and decreased performance. In addition, the failure of a second AMD may require the system to shut down in an effort to protect itself from thermally induced damage. This forced shutdown is often required due to the resulting misdistribution of airflow within the system rather than lack of sufficient total system airflow.

BRIEF SUMMARY

According to one embodiment of the present disclosure, an approach is provided in which a cooling manager detects a failed fan included in an electronic enclosure. The electronic enclosure includes multiple fans that each cool different component areas in the electronic enclosure. The cooling manager selects an airflow compensator that corresponds to a functioning fan included in the electronic enclosure, which includes a fixed perforated member and a movable perforated member. In turn, the cooling manager adjusts the selected airflow compensator to redirect a portion of airflow generated by the functioning fan to the component area corresponding to the failed fan.

The foregoing is a summary and thus contains, by necessity, simplifications, generalizations, and omissions of detail; consequently, those skilled in the art will appreciate that the summary is illustrative only and is not intended to be in any way limiting. Other aspects, inventive features, and advantages of the present disclosure, as defined solely by the claims, will become apparent in the non-limiting detailed description set forth below.

BRIEF DESCRIPTION OF THE SEVERAL VIEWS OF THE DRAWINGS

The present disclosure may be better understood, and its numerous objects, features, and advantages made apparent to those skilled in the art by referencing the accompanying drawings, wherein:

FIG. 6 is a block diagram of a data processing system in which the methods described herein can be implemented.

DETAILED DESCRIPTION

Figure 1:
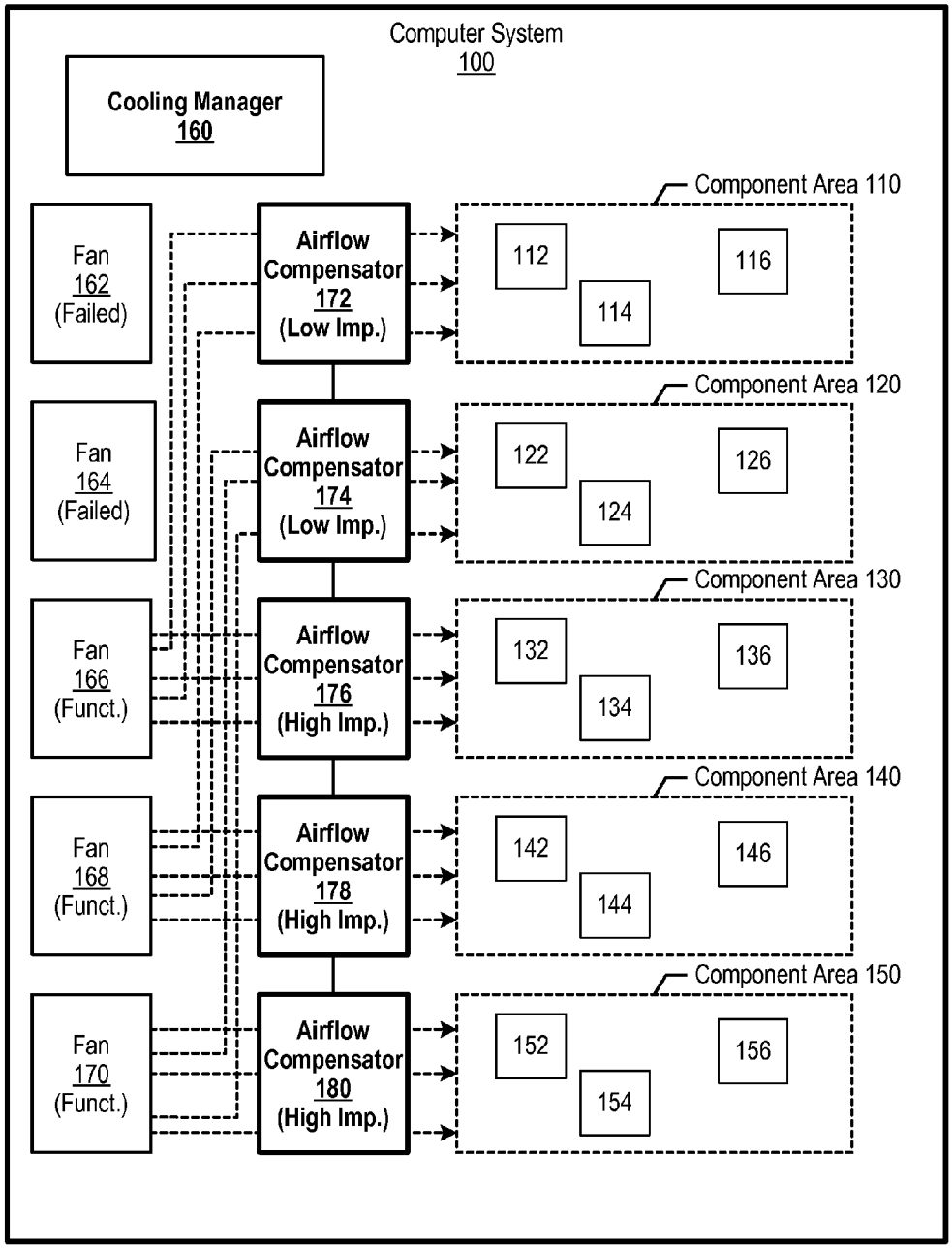
FIG. 1 is a diagram showing a cooling manager adjusting airflow compensators in order to redistribute airflow generated by functioning fans to component areas corresponding to failed fans.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

As will be appreciated by one skilled in the art, aspects of the present disclosure may be embodied as a system, method or computer program product. Accordingly, aspects of the present disclosure may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present disclosure are described below with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The following detailed description will generally follow the summary of the disclosure, as set forth above, further explaining and expanding the definitions of the various aspects and embodiments of the disclosure as necessary.

FIG. 1 is a diagram showing a cooling manager adjusting airflow compensators in order to redistribute airflow generated by functioning fans to component areas corresponding to failed fans. Computer system 100 includes airflow compensators 172-180 that direct airflow from corresponding fans 162-170 to component areas 110-150.

Each particular fan corresponds to a "primary" component area for which to cool that includes components directly downstream of the particular. The term "component areas" referred to herein identifies general regions of a larger electronic enclosure and, in one embodiment, are not necessarily divided or segregated by walls or bulkheads. Fan 162 corresponds to component area 110, which includes components 112, 114, and 116. Fan 164 corresponds to component area 120, which includes components 122, 124, and 126. Fan 166 corresponds to component area 130, which includes components 132, 134, and 136. Fan 168 corresponds to component area 140, which includes components 142, 144, and 146. And, fan 170 corresponds to component area 150, which includes components 152, 154, and 156.

When a certain number of fans fail, a portion of airflow generated by the remaining functional fans is redistributed to the failed fans' airflow compensators. Airflow compensators 172-180 include two levels of perforated screens. In one embodiment, the airflow compensators include one main fixed screen and multiple movable screens (one for each airflow compensator, see FIGS. 4A, 4B, and corresponding text for further details). The movable screens, which have the same perforation geometry as the main screen, are mounted in contact with the main screen with perforations aligned so as to pose no additional airflow impedance, referred to herein as a "low impedance position." This arrangement is maintained while all fans are functional and each airflow compensator has roughly 55% free open area in this state (see FIG. 4A and corresponding text for further details).

Figure 4A:
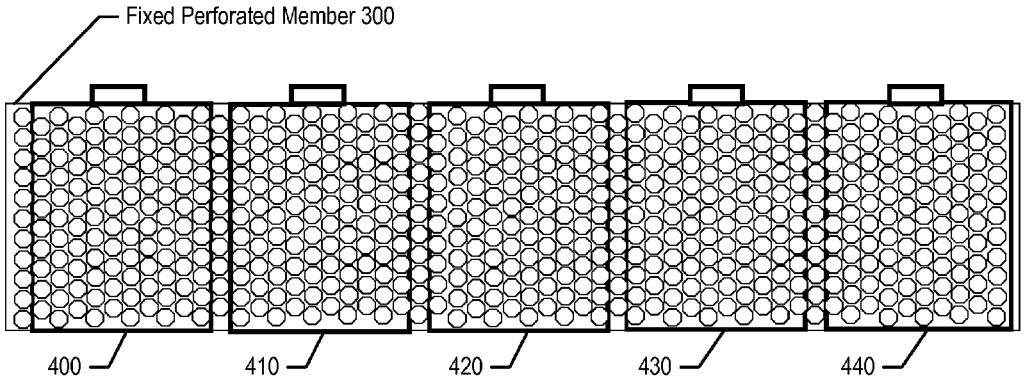
FIG. 4A is a diagram showing an example of an airflow compensator that includes a fixed perforated member and multiple movable perforated members that are each in a low impedance position.
Figure 4B:
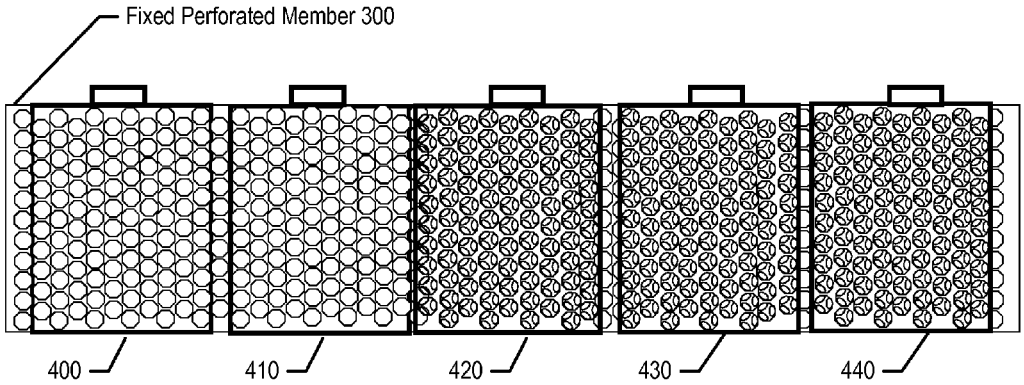
FIG. 4B is a diagram showing an example of an airflow compensator that includes three movable perforated members in a high impedance position.

When a number of fan failures, which may be a predefined value, are detected by computer system 100, cooling manager 160 ramps up the speed of the remaining functioning fans to a higher speed value and their corresponding airflow compensators are moved one half of the perforation pitch to create regions of roughly 20% free open area and greatly increase the flow impedance directly downstream of the functional fans, referred to herein as a "high impedance position" (see FIG. 4B and corresponding text for further details). Cooling manager 160 may be, in one embodiment, a cooling module that includes one or more processors that execute instructions stored in a memory area to perform functions described here.

The example in FIG. 1 shows that fans 162 and 164 are failed. Therefore, airflow compensators 176, 178, and 180 are moved to a high impedance position, thus causing a portion of airflow generated by fans 166, 168, and 170 to be redirected through airflow compensators 172 and 174 to cool component areas 110 and 120. In one embodiment, the actuation and movement of each airflow compensator is reversible between the low impedance and high impedance positions, as the failure of a subsequent fan may necessitate the opening of its compensator from the high impedance "functioning" position to the low impedance "failed" position.

Figure 2:
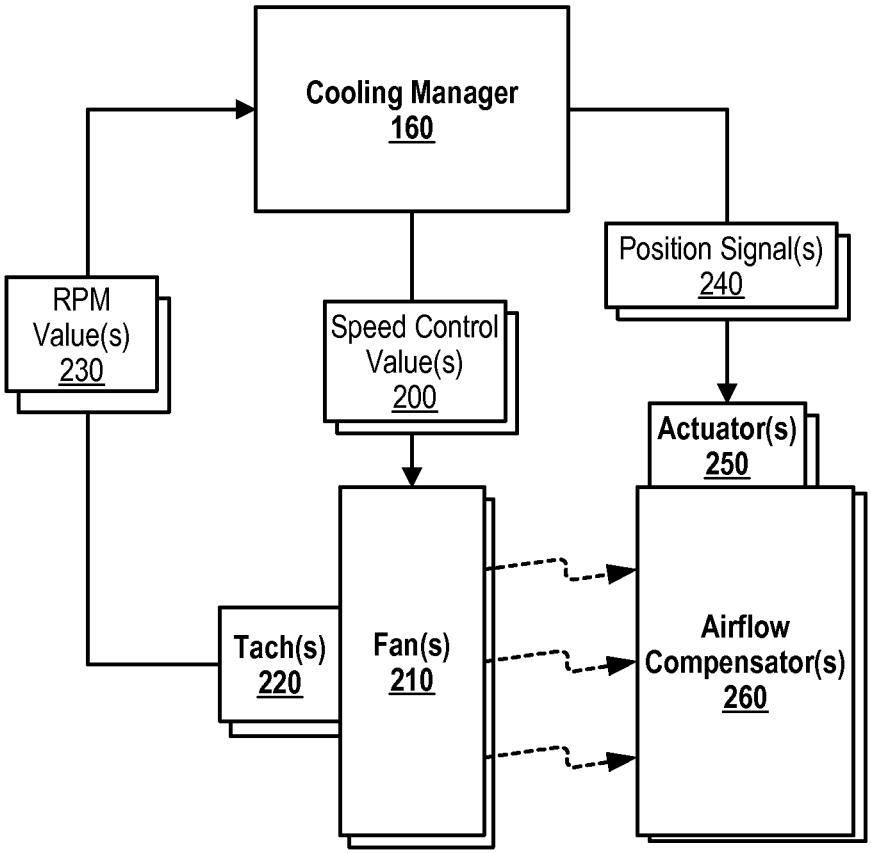
FIG. 2 is a diagram showing a cooling manager receiving fan speed input and adjusting the fan's corresponding airflow compensator accordingly.

FIG. 2 is a diagram showing a cooling manager receiving fan speed input and adjusting the fan's corresponding airflow compensator accordingly. Cooling manager 160 provides speed control values 200 to fans 210 according to thermal conditions at the fans' corresponding component areas. As fans 210 rotate, tachometers 220 generate RPM (revolutions per minute) values 230, which indicate the speed at which each of fans 210 rotates. Cooling manager 160 monitors RPM values 230 to ensure that each of fans 210 is functioning correctly.

When cooling manager 160 detects that a particular number of fans have failed, cooling manager 160 identifies the remaining functioning fans and sends position signals 240 to actuators 250 corresponding to the functioning fans' airflow compensators 260. Position signals 240 instruct actuators 250 to close the movable perforated member of airflow compensators 260 to a high impedance position, thus redirecting a portion of airflow produced by the functioning fans to component areas initially designated to be cooled by the failed fans. In one embodiment, if one of the remaining functioning fans were to fail, its corresponding air flow compensator would be moved back to the low impedance state.

Figure 3A:
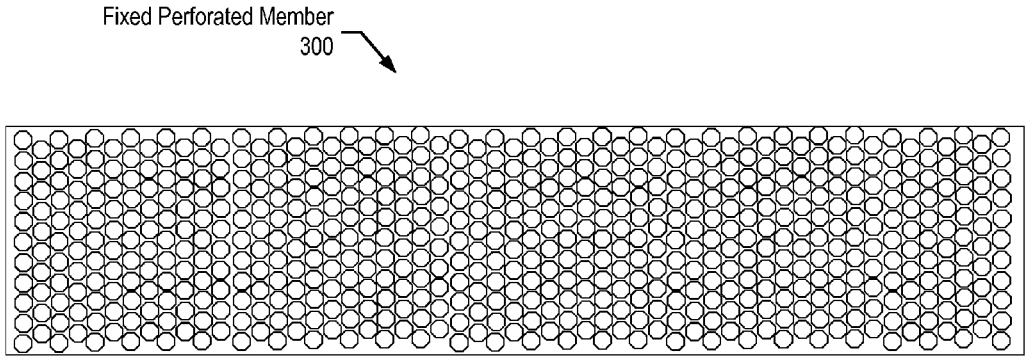
FIG. 3A is a diagram showing an example of an airflow compensator's fixed perforated member.

FIG. 3A is a diagram showing an example of an airflow compensator's fixed perforated member. Fixed perforated member 300, in one embodiment, is a thin screen with perforations that comprise approximately 55% of fixed perforated member 300. The impedance to airflow is a strong function of percent open area. As such, when moveable perforated members are inline (e.g., a low impedance position), the fan's airflow experiences a relatively small resistance to flow (see FIG. 4A and corresponding text for further details)

Figure 3B:
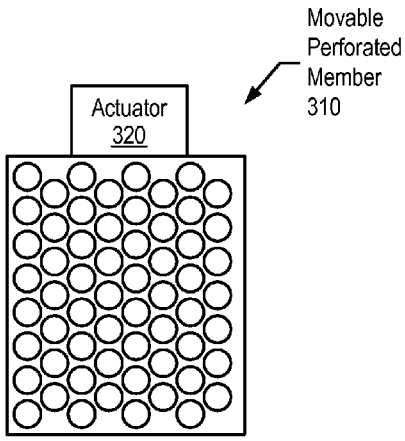
FIG. 3B is a diagram showing an example of an airflow compensator's movable perforated member.

FIG. 3B is a diagram showing an example of an airflow compensator's movable perforated member. Movable perforated member 310, in one embodiment, is a thin screen with perforations similar to fixed perforated member 300. As such, when movable perforated member 310 is in a low impedance position, its perforations are lined up with fixed perforated member 300's perforations, thus reducing any additional impedance generated by fixed perforated member 300. However, when movable perforated member 310 is moved to a high impedance position via actuator 320, which is one half of the perforation pitch, regions of roughly 20% free open area remain, thus greatly increasing the airflow impedance downstream of the functional fans (see FIG. 4B and corresponding text for further details).

Figure 3C:
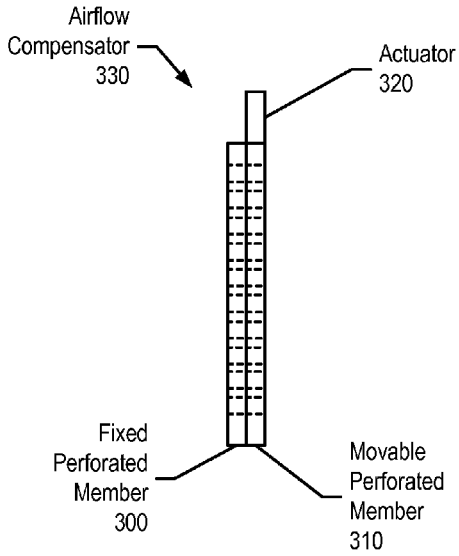
FIG. 3C is a diagram showing a cross-section example of an airflow compensator.

FIG. 3C is a diagram showing a cross-section example of an airflow compensator. As can be seen, airflow compensator 330 includes fixed perforated member 300 adjacent to movable perforated member 310, which slides according to position signals received at actuator 320.

FIG. 4A is a diagram showing an example of an airflow compensator that includes a fixed perforated member and multiple movable perforated members that are each in a low impedance position. Movable perforated members 400-440 correspond to five different fans, such as fans 162-170 shown in FIG. 1. FIG. 4A shows that each of movable perforated members 400-440 are in a low impedance position as evidenced by their perforations aligning with fixed perforated member 300's perforations, which indicates that each of the fans are functioning correctly.

FIG. 4B is a diagram showing an example of an airflow compensator that includes three movable perforated members in a high impedance position. Movable perforated members 420, 430, and 440 are in a high impedance position as evidenced by their perforation offsets relative to fixed perforation member 300's perforations.

FIG. 4B's example may be related to FIG. 1 in that airflow compensators 172 and 174 are in a low impedance position to compensate for their corresponding failed fans 162 and 164. FIG. 4B's movable perforated members 400 and 410 illustrate such low impedance position with airflow compensators 172 and 174. Likewise, FIG. 1's airflow compensators 176, 178, and 180 are in a high impedance position to redirect a portion of airflow generated by fans 166, 168, and 170 through airflow compensators 172 and 174. FIG. 4B's movable perforated members 420, 430, and 440 correspond to airflow compensators 176, 178, and 180 in the high impedance position.

As those skilled in the art can appreciate, the example shown in FIG. 4 demonstrates just one embodiment for five fans, whereas the device itself may be designed to accommodate a range of fan numbers and sizes. In addition, this example shows simply one possible fan failure configuration, whereas a large number of possible fan failure scenarios or combinations may exist for a given fan configuration that may be accommodated by the present disclosure.

Figure 5:
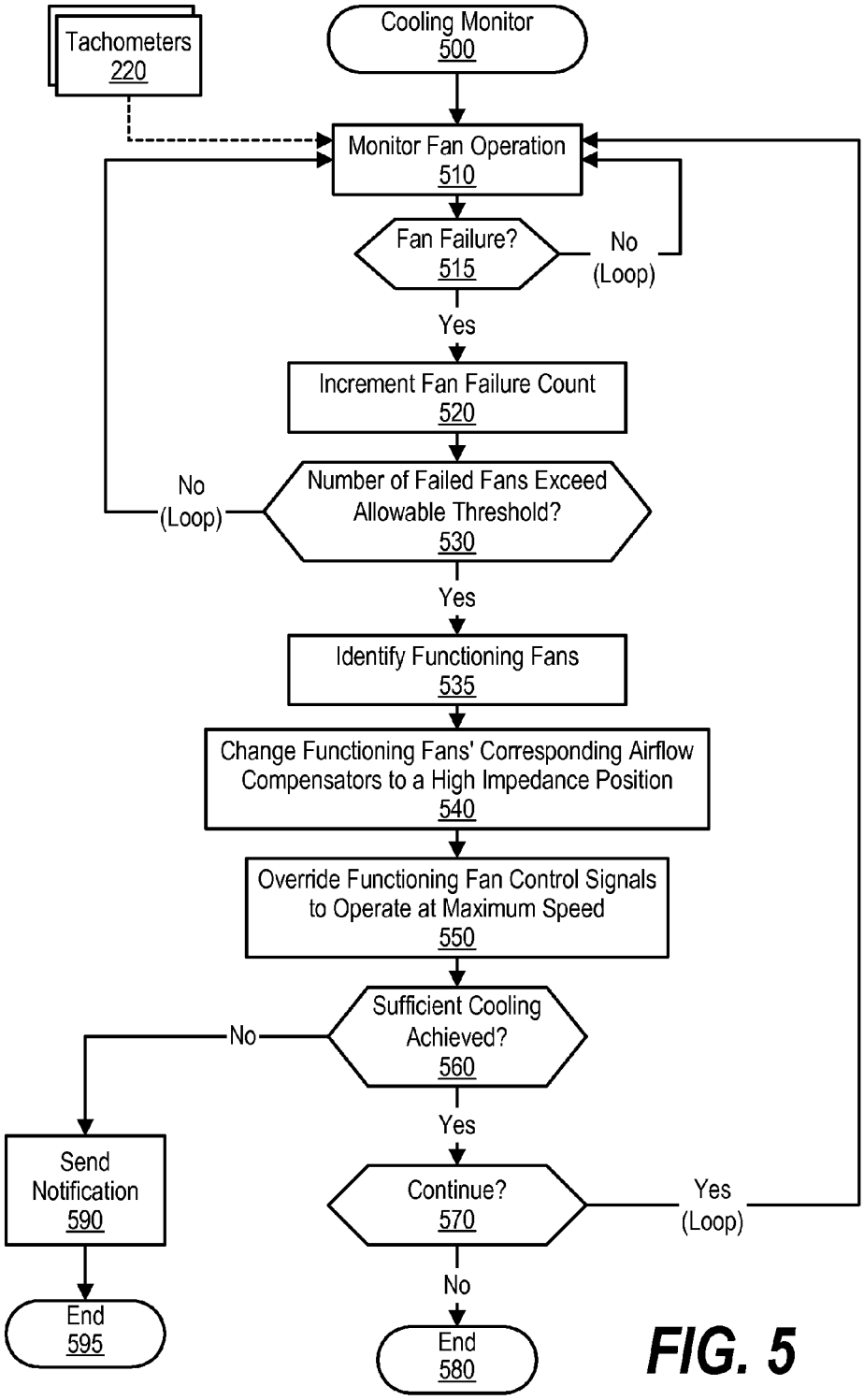
FIG. 5 is a flowchart showing steps taken in a cooling manager monitoring fan operation and adjusting airflow compensators accordingly.

FIG. 5 is a flowchart showing steps taken in a cooling manager monitoring fan operation and adjusting airflow compensators accordingly. Processing commences at 500, whereupon the cooling manager monitors fan operation by receiving speed signals from tachometers 220 at step 510.

A determination is made as to whether a fan is not rotating at the correct speed and is failing (decision 515). If no fan failure is detected, decision 515 branches to the "No" branch, which loops back to continue monitoring fan operation. This looping continues until the cooling manger detects a fan failure, at which point decision 515 branches to the "Yes" branch, whereupon processing increments a fan failure count at step 520. The fan failure count tracks the number of failed fans in the computer system. In one embodiment, the cooling manager may not track the number of failed fans, but rather instigate airflow redirection procedures when a single fan fails. In another embodiment, the cooling manager waits until a certain number of fans fail before instigating airflow redirection procedures (discussed below).

A determination is made as to whether the number of failed fans exceeds a threshold (decision 530). For example, the computer system may not take action until the number of failed fans is greater than or equal to two. If the number of failed fans does not exceed the threshold, decision 530 branches to the "No" branch, which loops back to continue monitoring fan operation.

On the other hand, if the number of failed fans exceeds the threshold, decision 530 branches to the "Yes" branch, whereupon the cooling manager identifies the fans that are still functioning correctly (step 535). Next, the cooling manager adjusts the functioning fans' corresponding airflow compensators to a high impedance position at step 550. Using the example shown in FIG. 1, processing adjusts airflow compensators 176, 178, and 180 since fans 166, 168, and 170 are still functioning, thus redirecting airflow through airflow compensators 172 and 174 to compensate for failed fans 162 and 164, respectively.

At step 550, the cooling manager overrides the speed control signals sent to the functioning fans with a higher speed value, and a determination is made as to whether the failed fans' corresponding component areas are under a pre-defined temperature (decision 560). If the failed fans' corresponding component areas fail to be under the pre-defined temperature, decision 560 branches to the "No" branch, whereupon decision 560 branches to the "No" branch, whereupon processing sends a notification, such as a system administrator, that the component area is exceeding the pre-defined temperature (step 590), and processing ends at 595.

On the other hand, if the failed fans' corresponding component area is under the pre-defined temperature, decision 560 branches to the "Yes" branch, whereupon a determination is made as to whether to continue monitoring fan operation (decision 570). If so, decision 570 branches to the "Yes" branch, which loops back to monitor fan operation. This looping continues until processing should terminate fan monitoring (e.g., computer shut-down), at which point decision 570 branches tot eh "No" branch, whereupon processing ends at 580.

FIG. 6 illustrates information handling system 600, which is a simplified example of a computer system capable of performing the computing operations described herein. Information handling system 600 includes one or more processors 610 coupled to processor interface bus 612. Processor interface bus 612 connects processors 610 to Northbridge 615, which is also known as the Memory Controller Hub (MCH). Northbridge 615 connects to system memory 620 and provides a means for processor(s) 610 to access the system memory. Graphics controller 625 also connects to Northbridge 615. In one embodiment, PCI Express bus 618 connects Northbridge 615 to graphics controller 625. Graphics controller 625 connects to display device 630, such as a computer monitor.

Northbridge 615 and Southbridge 635 connect to each other using bus 619. In one embodiment, the bus is a Direct Media Interface (DMI) bus that transfers data at high speeds in each direction between Northbridge 615 and Southbridge 635. In another embodiment, a Peripheral Component Interconnect (PCI) bus connects the Northbridge and the Southbridge. Southbridge 635, also known as the I/O Controller Hub (ICH) is a chip that generally implements capabilities that operate at slower speeds than the capabilities provided by the Northbridge. Southbridge 635 typically provides various busses used to connect various components. These busses include, for example, PCI and PCI Express busses, an ISA bus, a System Management Bus (SMBus or SMB), and/or a Low Pin Count (LPC) bus. The LPC bus often connects low-bandwidth devices, such as boot ROM 696 and "legacy" I/O devices (using a "super I/O" chip). The "legacy" I/O devices (698) can include, for example, serial and parallel ports, keyboard, mouse, and/or a floppy disk controller. The LPC bus also connects Southbridge 635 to Trusted Platform Module (TPM) 695. Other components often included in Southbridge 635 include a Direct Memory Access (DMA) controller, a Programmable Interrupt Controller (PIC), and a storage device controller, which connects Southbridge 635 to nonvolatile storage device 685, such as a hard disk drive, using bus 684.

ExpressCard 655 is a slot that connects hot-pluggable devices to the information handling system. ExpressCard 655 supports both PCI Express and USB connectivity as it connects to Southbridge 635 using both the Universal Serial Bus (USB) the PCI Express bus. Southbridge 635 includes USB Controller 640 that provides USB connectivity to devices that connect to the USB. These devices include webcam (camera) 650, infrared (IR) receiver 648, keyboard and trackpad 644, and Bluetooth device 646, which provides for wireless personal area networks (PANs). USB Controller 640 also provides USB connectivity to other miscellaneous USB connected devices 642, such as a mouse, removable nonvolatile storage device 645, modems, network cards, ISDN connectors, fax, printers, USB hubs, and many other types of USB connected devices. While removable nonvolatile storage device 645 is shown as a USB-connected device, removable nonvolatile storage device 645 could be connected using a different interface, such as a Firewire interface, etcetera.

Wireless Local Area Network (LAN) device 675 connects to Southbridge 635 via the PCI or PCI Express bus 672. LAN device 675 typically implements one of the IEEE 802.11 standards of over-the-air modulation techniques that all use the same protocol to wireless communicate between information handling system 600 and another computer system or device. Optical storage device 690 connects to Southbridge 635 using Serial ATA (SATA) bus 688. Serial ATA adapters and devices communicate over a high-speed serial link. The Serial ATA bus also connects Southbridge 635 to other forms of storage devices, such as hard disk drives. Audio circuitry 660, such as a sound card, connects to Southbridge 635 via bus 658. Audio circuitry 660 also provides functionality such as audio line-in and optical digital audio in port 662, optical digital output and headphone jack 664, internal speakers 666, and internal microphone 668. Ethernet controller 670 connects to Southbridge 635 using a bus, such as the PCI or PCI Express bus. Ethernet controller 670 connects information handling system 600 to a computer network, such as a Local Area Network (LAN), the Internet, and other public and private computer networks.

While FIG. 6 shows one information handling system, an information handling system may take many forms. For example, an information handling system may take the form of a desktop, server, portable, laptop, notebook, or other form factor computer or data processing system. In addition, an information handling system may take other form factors such as a personal digital assistant (PDA), a gaming device, ATM machine, a portable telephone device, a communication device or other devices that include a processor and memory.

While particular embodiments of the present disclosure have been shown and described, it will be obvious to those skilled in the art that, based upon the teachings herein, that changes and modifications may be made without departing from this disclosure and its broader aspects. Therefore, the appended claims are to encompass within their scope all such changes and modifications as are within the true spirit and scope of this disclosure. Furthermore, it is to be understood that the disclosure is solely defined by the appended claims. It will be understood by those with skill in the art that if a specific number of an introduced claim element is intended, such intent will be explicitly recited in the claim, and in the absence of such recitation no such limitation is present. For non-limiting example, as an aid to understanding, the following appended claims contain usage of the introductory phrases "at least one" and "one or more" to introduce claim elements. However, the use of such phrases should not be construed to imply that the introduction of a claim element by the indefinite articles "a" or "an" limits any particular claim containing such introduced claim element to disclosures containing only one such element, even when the same claim includes the introductory phrases "one or more" or "at least one" and indefinite articles such as "a" or "an"; the same holds true for the use in the claims of definite articles.

The invention claimed is:

1. A method comprising:

detecting a failed fan from a plurality of fans included in an electronic enclosure, wherein each of the plurality of fans corresponds to one of a plurality of component areas in an electronic enclosure;

selecting an airflow compensator from a plurality of airflow compensators in response to the detecting, wherein the selected airflow compensator corresponds to a functioning fan included in the plurality of fans and comprises a fixed perforated member and a movable perforated member; and adjusting the selected airflow compensator to direct a portion of airflow generated by the functioning fan to the one of the plurality of component areas corresponding to the failed fan, wherein the selected airflow compensator is re-adjusted in response to detecting a failure of the functioning fan.

2. The method of claim 1 wherein the plurality of component areas are in a single open area allowing the generated airflow to dispense between two or more of the plurality of component areas.

3. The method of claim 1 further comprising:

identifying a fan speed value that corresponds to the functioning fan; and overriding the fan speed value with a higher speed value that instructs the functioning fan to operate at higher speed.

4. The method of claim 1 further comprising:

identifying a number of failed fans in response to the detecting;

determining that the number of failed fans is greater than or equal to two;

identifying one or more remaining functioning fans included in the plurality of fans, the functioning fan included in the one or more remaining functioning fans;

selecting one or more of the plurality of airflow compensators that correspond to the one or more remaining functioning fans; and adjusting each of the selected airflow compensators to redirect a portion of airflow generated by their respective functioning fans to the plurality of component areas corresponding to the failed fans.

5. The method of claim 1 further comprising:

determining that the redirected airflow fails to reduce the failed fan's component area's temperature to a value under a pre-defined threshold; and sending a notification to terminate operation in response to the determination.

6. The method of claim 1 wherein the adjusting is performed by an actuator that only has a high impedance position and a low impedance position, wherein the actuator is in the low impedance position prior to the adjusting and in the high impedance position subsequent to the adjusting.

7. The method of claim 6 wherein the low impedance position increases airflow generated by the functioning fan to the functioning fan's corresponding component area and the high impedance position increases airflow generated by the functioning fan to the failed fan's corresponding component area.

8. The method of claim 6 wherein the actuator is re-adjusted to the low impedance position in response to the detection of the failure of the functioning fan.

9. A method comprising:

detecting a failed fan from a plurality of fans included in an electronic enclosure, wherein each of the plurality of fans corresponds to one of a plurality of component areas in an electronic enclosure, and wherein the plurality of component areas are in a single open area allowing the generated airflow to dispense between two or more of the plurality of component areas;

selecting an airflow compensator from a plurality of airflow compensators in response to the detecting, wherein the selected airflow compensator corresponds to a functioning fan included in the plurality of fans and comprises a fixed perforated member and a movable perforated member;

adjusting the movable perforated member to direct a portion of airflow generated by the functioning fan to the one of the plurality of component areas corresponding to the failed fan, wherein the adjusting is performed by an actuator that only has a high impedance position and a low impedance position, wherein the actuator is in the low impedance position prior to the adjusting and in the high impedance position subsequent to the adjusting;

identifying a fan speed value that corresponds to the functioning fan; and overriding the fan speed value with a higher speed value that instructs the functioning fan to operate at higher speed, wherein the actuator is re-adjusted in response to detecting a failure of the functioning fan.

* * * * *